US006753582B2

(12) United States Patent
Ma

(10) Patent No.: US 6,753,582 B2
(45) Date of Patent: Jun. 22, 2004

(54) BUCKLING BEAM BI-STABLE MICROELECTROMECHANICAL SWITCH USING ELECTRO-THERMAL ACTUATION

(75) Inventor: Qing Ma, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/218,290

(22) Filed: Aug. 14, 2002

(65) Prior Publication Data

US 2004/0032000 A1 Feb. 19, 2004

(51) Int. Cl.[7] ..... H01L 29/82
(52) U.S. Cl. ..... 257/415; 310/306; 310/307
(58) Field of Search ..... 310/306, 307, 310/309

(56) References Cited

U.S. PATENT DOCUMENTS 6,310,419 B1 * 10/2001 Wood ..... 310/306
6,407,478 B1 * 6/2002 Wood et al. ..... 310/307

OTHER PUBLICATIONS

Qiu, Jin.,et al. ,"A Centrally–Clamped Parallel–Beam Bistable MEMS Mechanism", *IEEE 2001,* 352–356.

* cited by examiner

*Primary Examiner*—David Nelms
*Assistant Examiner*—Mai-Huong Tran
(74) *Attorney, Agent, or Firm*—Schwegman, Lundberg, Woessner & Kluth, P.A.

(57) ABSTRACT

A microelectromechanical system (MEMS) that includes a first electro-thermal actuator, a second electro-thermal actuator and a beam having a first side and a second side. The first electro-thermal actuator applies a force to the first side of the beam as current passes through the first electro-thermal actuator and the second electro-thermal actuator applies a force to the second side of the beam as current passes through the second electro-thermal actuator.

20 Claims, 9 Drawing Sheets

BUCKLING BEAM BI-STABLE MICROELECTROMECHANICAL SWITCH USING ELECTRO-THERMAL ACTUATION

TECHNICAL FIELD

A microelectromechanical systems (MEMS) switch, and in particular a MEMS switch that operates using low actuation voltage.

BACKGROUND

A microelectromechanical system (MEMS) is a microdevice that integrates mechanical and electrical elements on a common substrate using microfabrication technology. The electrical elements are typically formed using known integrated circuit fabrication techniques. The mechanical elements are typically fabricated using lithographic and other related processes to perform micromachining, wherein portions of a substrate (e.g., silicon wafer) are selectively etched away or added to with new materials and structural layers. MEMS devices include actuators, sensors, switches, accelerometers, and modulators.

MEMS switches (i.e., contacts, relays, shunts, etc.) have intrinsic advantages over their conventional solid-state counterparts (e.g., field-effect transistor (FET) switches), including superior power efficiency, low insertion loss and excellent isolation. However, MEMS switches are generally much slower than solid-state switches. This limitation precludes applying MEMS switches in certain technologies where sub-microsecond switching is required, such as switching an antenna between transmit and receive in high-speed wireless communication devices.

There are antenna applications where MEMS switches are critically important because of the relatively low insertion loss. One such application is in a smart antenna application that relates to switching between a plurality of antennas within a wireless communication device. Smart antenna switching applications typically require switching speeds ranging from milliseconds to seconds depending on the systems.

One type of prior art MEMS switch includes a connecting member called a "beam" that is electro-thermally deflected or buckled. The buckled beam engages one or more electrical contacts to establish an electrical connection between the contacts.

FIGS. 1 and 1A illustrate a prior art MEMS switch 10 that includes a beam 12 which is electro-thermally buckled. Beam 12 is formed of a high thermal expansion conductor 14 and a low thermal expansion dielectric 16. Conductor 14 and dielectric 16 are restrained at opposing ends by anchors 18A, 18B.

Activation of MEMS switch 10 is illustrated in FIG. 1A. A voltage is applied across beam 12 such that current travels through beam 12 with much more of the current passing through low resistance conductor 14. As current passes through beam 12 (indicated by arrows A in FIG. 1A), there is resistive heating generated within beam 12 that causes beam 12 to thermally expand. The large differential between the thermal expansion of conductor 14 and dielectric 16 causes beam 12 to buckle outward toward the side of conductor 14. As beam 12 buckles, a contact stud 20 mounted on beam 12 engages contacts 22A, 22B so that signals (indicated by arrows B in FIG. 1A) can be passed between contacts 22A, 22B.

One benefit of using an electro-thermally deflected beam is that the switch requires a relatively low actuation voltage during operation. However, when the MEMS switch is in the actuated position, power is being consumed continuously in order to maintain the resistive heating within the beam.

FIG. 2 illustrates another prior art MEMS switch 30 that includes a beam 32 which is secured at opposite ends to anchors 34A, 34B. Beam 32 is secured to anchors 34A, 34B in a manner that places beam 32 under compressive stress. The compressive stress causes beam 32 to buckle. Beam 32 needs to remain in a buckled state for MEMS switch 30 to operate appropriately.

A lateral actuation electrode 36 is positioned adjacent to beam 32 at the level beam 32 would occupy were it not buckled from the compressive stress. This level of beam 32 is referred to as the neutral position and is indicated in FIG. 2 with line 38. A voltage is applied to lateral actuation electrode 36 to generate an electrostatic force that pulls beam 32 up or down toward its neutral position. The inertia of beam 32 carries it past the neutral position to the other side where beam 32 electrically connects contacts (not shown) to allow signals to pass between the contacts.

MEMS switch 30 does not require any power to maintain beam 32 in either the up or down position. One drawback associated with MEMS switch 30 is that large actuation voltages are required with electrostatic actuation in general, and in particular when electrostatic actuation is used to maneuver a buckled beam.

BRIEF DESCRIPTION OF THE DRAWINGS

In the Figures, like reference numbers refer to like elements.

DETAILED DESCRIPTION

Figure 1A:
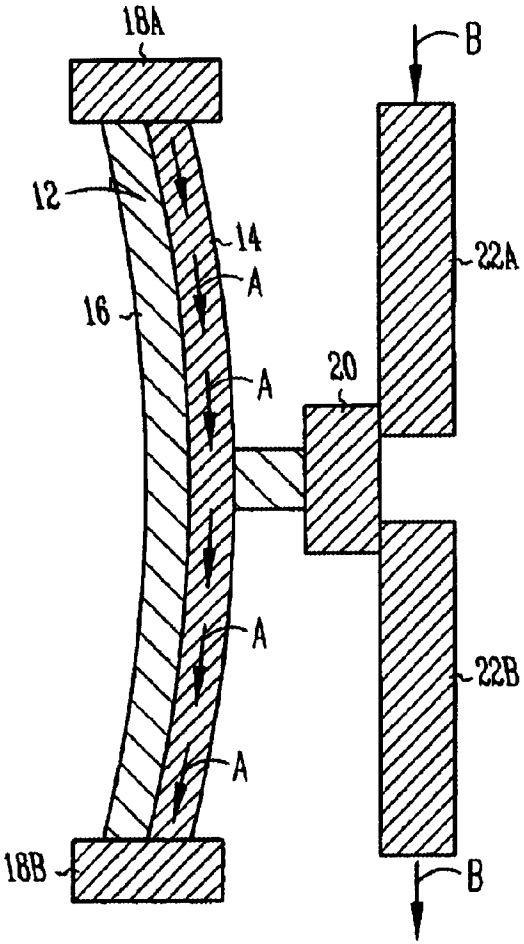
Fig. 1A (PRIOR ART)
FIG. 1A illustrates the MEMS switch of FIG. 1 with the electro-thermal beam activated such the switch is in a closed position.
Figure 1:
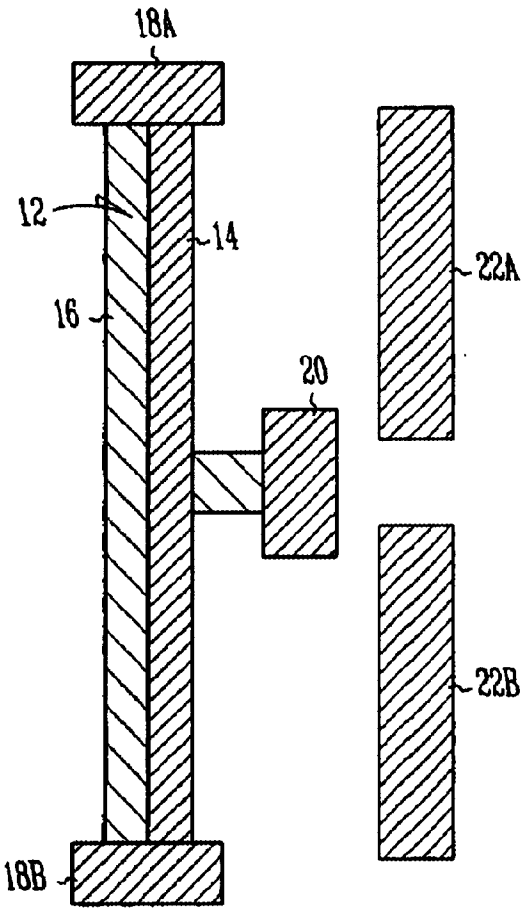
Fig. 1 (PRIOR ART)
FIG. 1 illustrates a prior art MEMS switch that includes an electro-thermal beam with the switch in an open position.
Figure 2:
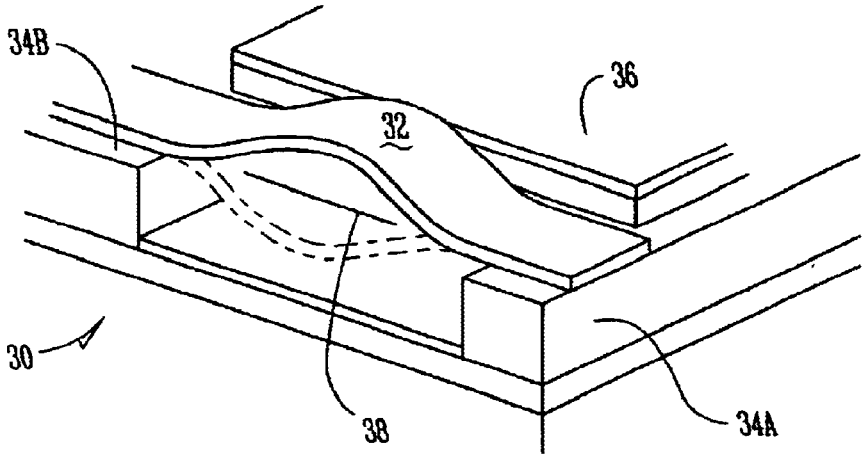
Fig. 2 (PRIOR ART)
FIG. 2 illustrates another type of prior art MEMS switch that includes a buckled beam which is manipulated by an electrostatic force.

In the following detailed description, reference is made to the accompanying drawings that show some example embodiments. These embodiments are described in sufficient detail to enable those skilled in the art to practice the invention. Other embodiments may be used, and structural, logical, and electrical changes made, without departing from the scope of the invention.

A microelectromechanical systems (MEMS) switch 50 that includes a beam 52, a first electro-thermal actuator 54 and a second electro-thermal actuator 56 is shown in FIGS. 3A, 3B, 3C and 3D. The beam 52 has a first side 58 and a second side 60.

First electro-thermal actuator 54 includes a first stud 62 that applies a force to the first side 58 of beam 52 as current passes through first electro-thermal actuator 54. In addition, second electro-thermal actuator 56 includes a second stud 64 that applies a force to the second side 60 of beam 52 as current passes through second electro-thermal actuator 56. Actuators 54, 56 may be connected to a circuit by bond pads or other conventional means so that the circuit can direct the supply of current to actuators 54, 56.

In some embodiments, MEMS switch 50 further comprises a transmission line 66 that includes at least a pair of electrically isolated contacts 67A, 67B. Contacts 67A, 67B may be connected to a circuit by bond pads or other conventional means. Beam 52 electrically connects contacts 67A, 67B after first electro-thermal actuator 54 applies a force to beam 52 to maneuver beam 52 against contacts 67A, 67B. As current passes through second electro-thermal actuator 56, second electro-thermal actuator 56 applies a force to beam 52 to disengage beam 52 from contacts 67A, 67B.

In the sample embodiments illustrated in FIGS. 3A, 3B, 3C and 3D, beam 52 is fixed at opposing ends to anchors 68A, 68B. Beam 52 is under a compressive stress such that beam 52 is buckled.

Figure 3A:
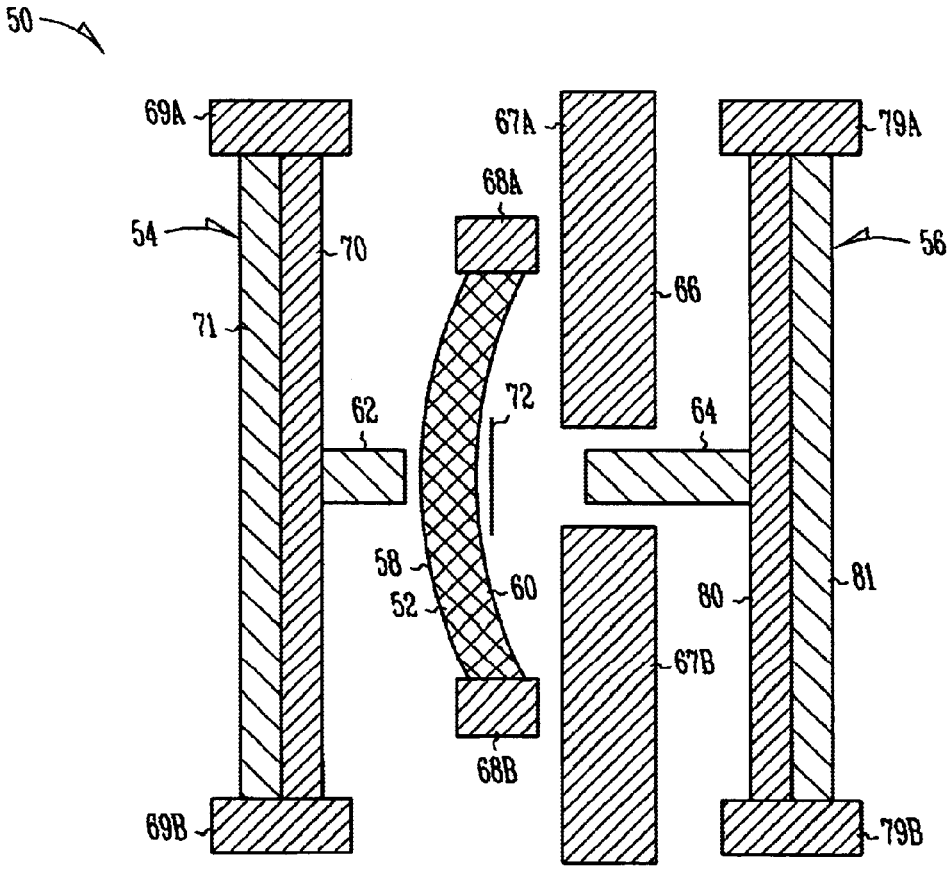
FIG. 3A illustrates an example embodiment of a MEMS switch with the MEMS switch off and no actuation voltage applied to the switch.
Figure 3B:
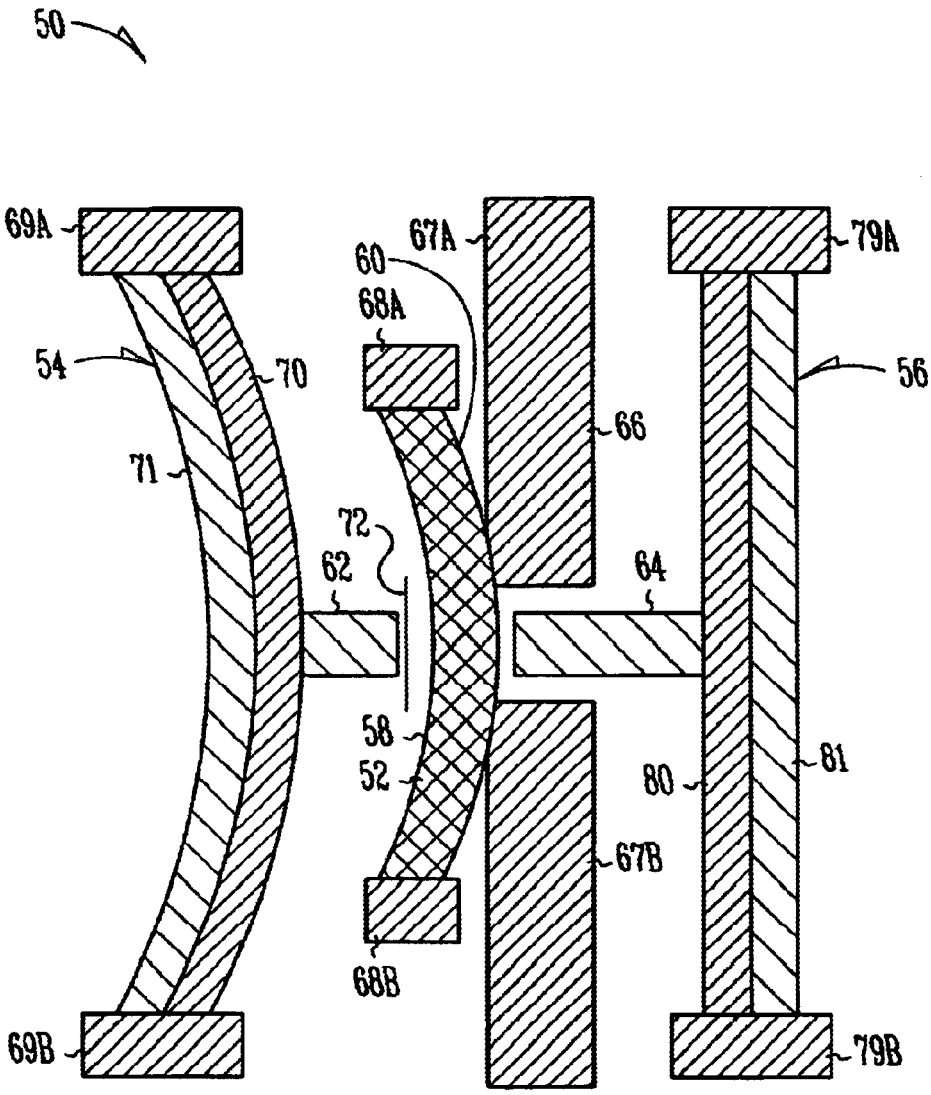
FIG. 3B illustrates the MEMS switch of FIG. 3A with the MEMS switch on and an actuation voltage applied to a first electro-thermal actuator in the switch.

FIG. 3A illustrates MEMS switch 50 when it is off and no actuation voltage is applied to either actuator 54, 56. As shown in FIG. 3B, MEMS switch 50 is turned on by applying an actuation voltage to first electro-thermal actuator 54. The actuation voltage generates current within actuator 54 that causes resistive heating within actuator 54.

First electro-thermal actuator 54 is fixed at opposing ends to anchors 69A, 69B, and in some embodiments is made up of a high thermal expansion conductor 70 and a low thermal expansion dielectric 71. The resistive heating causes the first electro-thermal actuator 54 to buckle outward on the side of conductor 70 due to the difference in thermal expansion between conductor 70 and dielectric 71.

As first electro-thermal actuator 54 buckles, it applies a force to beam 52 that is sufficient to move beam 52 toward its neutral position. The position that beam 52 would occupy were it not buckled from the compressive stress is referred to as the neutral position and is indicated in FIG. 3B with line 72. The inertia of beam 52 carries it past the neutral position to the other side where beam 52 electrically connects contacts 67A, 67B to allow signals to pass between contacts 67A, 67B. In some embodiments, first electro-thermal actuator 54 will continuously engage beam 52, while in other embodiments first electro-thermal actuator 54 will engage beam 52 only until beam 52 moves past its neutral position.

Figure 3C:
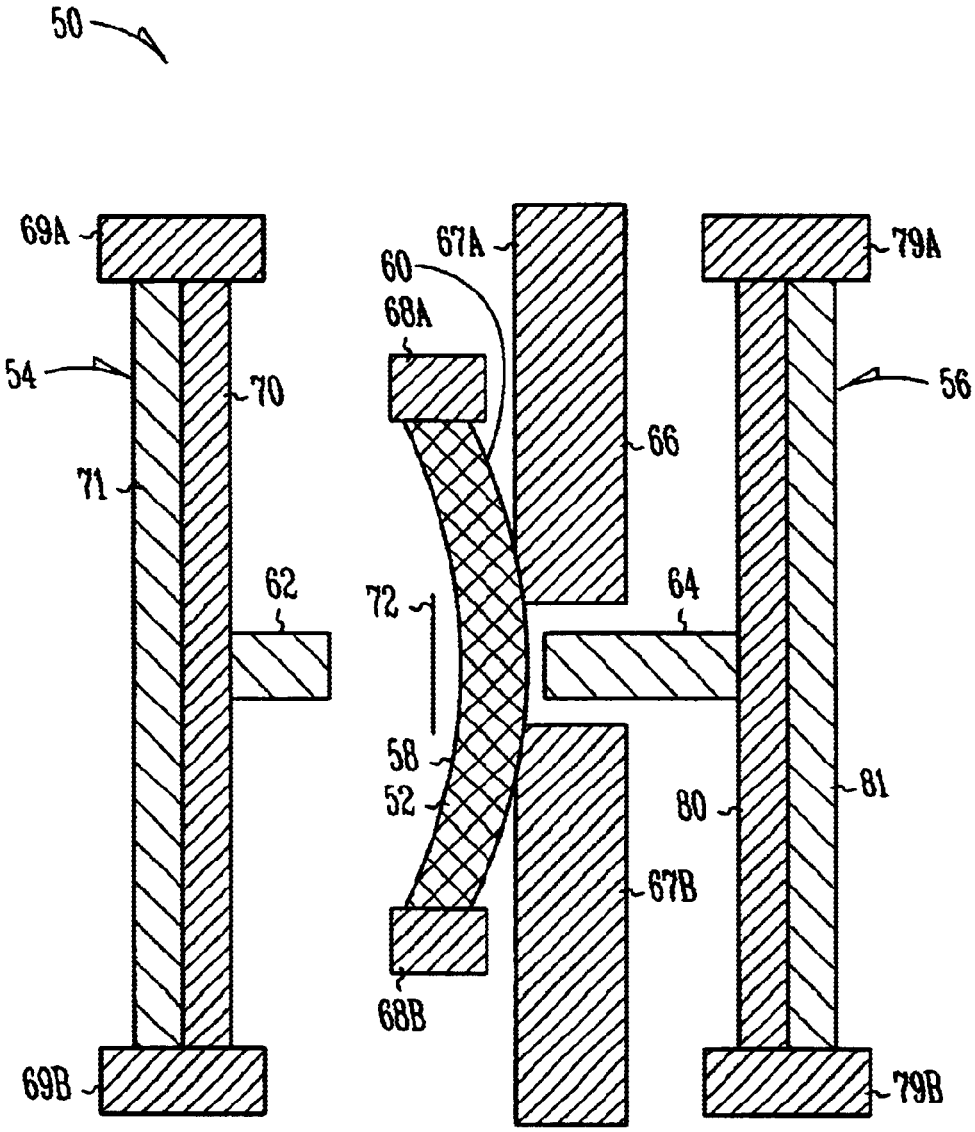
FIG. 3C illustrates the MEMS switch of FIG. 3A with the MEMS switch on and no actuation voltage applied to the first electro-thermal actuator in the switch.
Figure 3D:
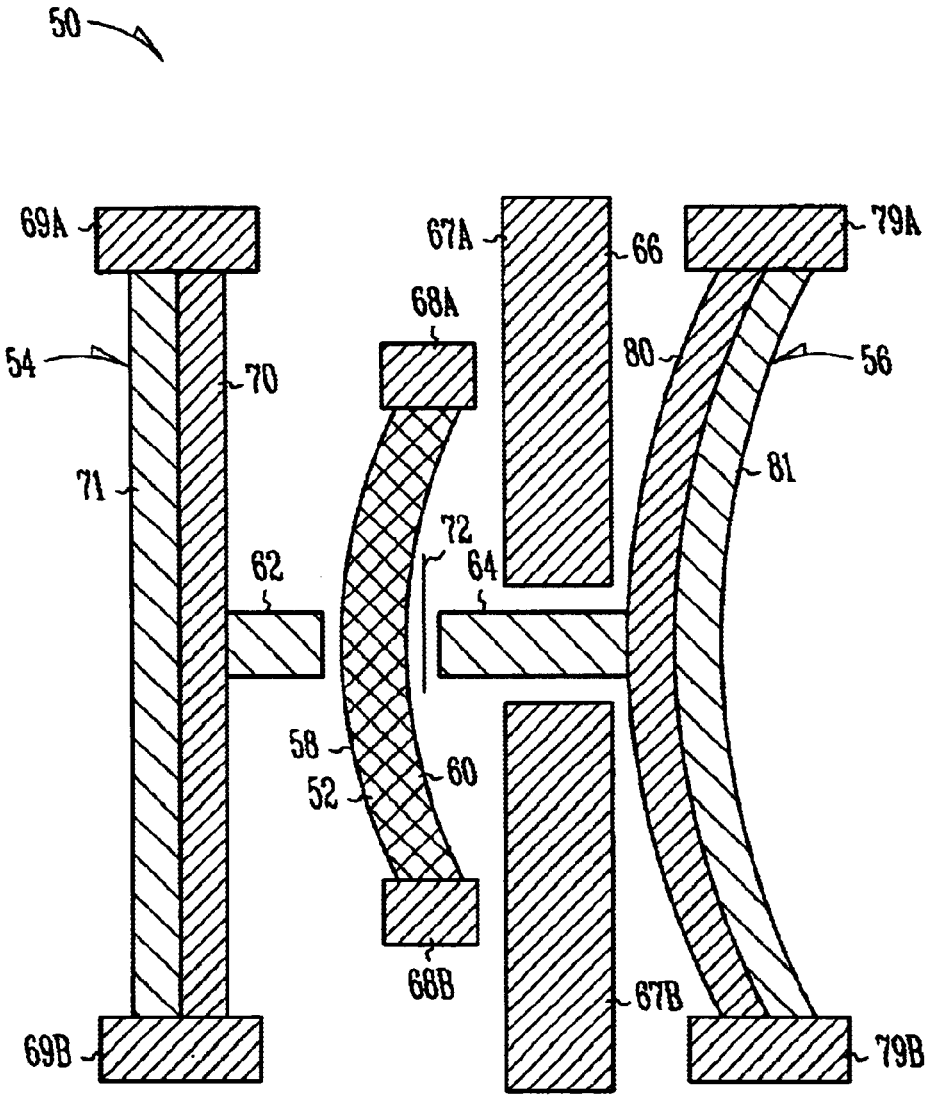
FIG. 3D illustrates the MEMS switch of FIG. 3A with the MEMS switch off and an actuation voltage applied to a second electro-thermal actuator in the switch.

FIG. 3C illustrates MEMS switch 50 when it is on and no actuation voltage is applied to either actuator 54, 56. As shown in FIG. 3D, MEMS switch 50 is turned off by applying an actuation voltage to second electro-thermal actuator 56. The actuation voltage generates current within actuator 56 that causes resistive heating within actuator 56.

Second electro-thermal actuator 56 is fixed at opposing ends to anchors 79A, 79B and may be similarly formed of a high thermal expansion conductor 80 and a low thermal expansion dielectric 81. The resistive heating causes second electro-thermal actuator 56 to buckle outward on the side of conductor 80 due to the difference in thermal expansion between conductor 80 and dielectric 81.

As second electro-thermal actuator 56 buckles, it applies a force to beam 52 that is sufficient to move beam 52 away from contacts 67A, 67B toward its neutral position. The inertia of beam 52 carries it past the neutral position to the other side where beam 52 can be engaged by first electro-thermal actuator 54 when it is necessary to again turn on MEMS switch 50.

In some embodiments, second electro-thermal actuator 56 will continuously engage beam 52, while in other embodiments actuator 56 will engage beam 52 only until beam 52 moves past its neutral position. Once beam 52 moves past the neutral position, the compressive stress will cause beam 52 to buckle outward away from contacts 67A, 67B. Contact between actuators 54, 56 and beam 52 when beam 52 is engaged with contacts 67A, 67B can cause interference with signals that are transferred between contacts 67A, 67B through beam 52.

Figure 5:
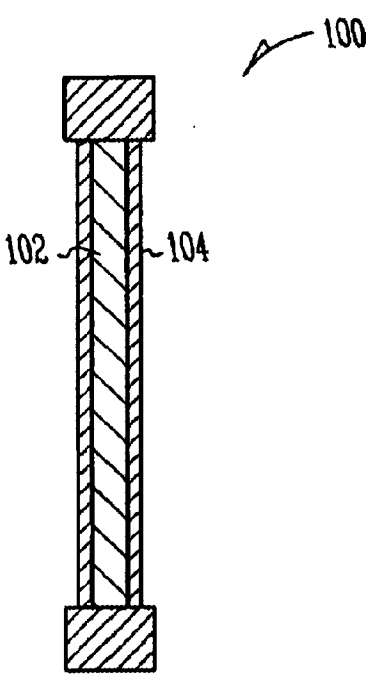
FIG. 5 illustrates another example beam that may be used in the MEMS switch of FIGS. 3A–3D.
Figure 4B:
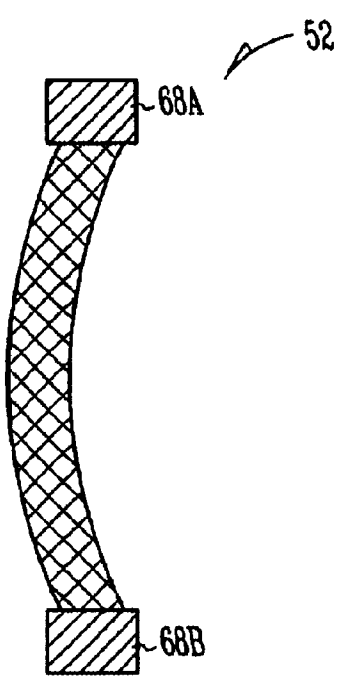
FIG. 4B illustrates the beam of FIG. 4A with the beam in a released state.
Figure 4A:
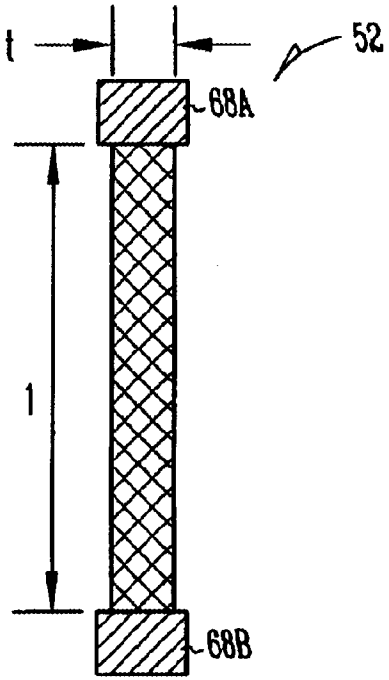
FIG. 4A illustrates the beam used in the MEMS switch of FIGS. 3A–3D with the beam in an unreleased state.

FIG. 4A shows beam 52 in an unreleased state during fabrication of beam 52 using lithographic and other related processes to perform micromachining, wherein portions are selectively etched away, or added to, with new materials and structural layers. As part of the fabrication process, beam 52 is released so that beam 52 is restrained only by anchors 68A, 68B. Beam 52 expands outward against anchors 68A, 68B to place beam 52 under compressive stress. The compressive stress is sufficient to cause beam 52 to buckle (see FIG. 4B). The critical stress for buckling is:

$$\sigma_{critical} = \frac{\pi^2}{3} E \left(\frac{t}{l}\right)^2$$

where l and t are shown in FIG. 4A and E depends on the material of beam 52. Beam 52 may be any material or combination of materials. One example beam 100 is shown in FIG. 5 where beam 100 is unreleased and includes a dielectric body 102 covered with an electrical conductor 104. Electrical conductor 104 facilitates transferring signals between isolated contacts that become electrically connected by beam 100 during operation of a MEMS switch that includes beam 100.

Figure 6C:
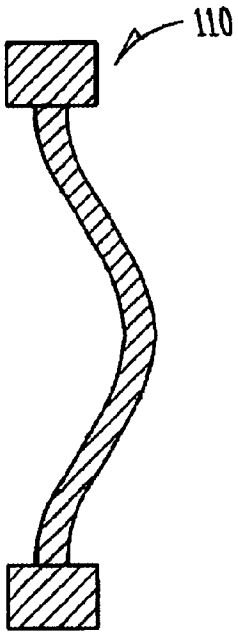
FIG. 6C illustrates the beam of FIGS. 6A and 6B after the beam is buckled by an actuating force.
Figure 6B:
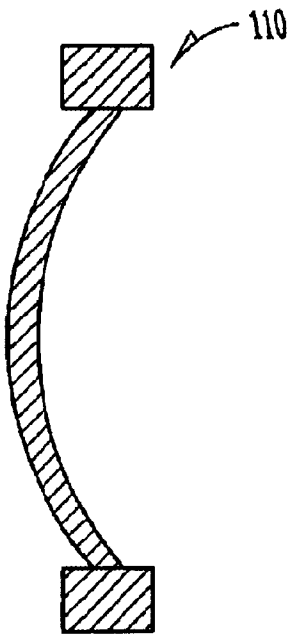
FIG. 6B illustrates the beam of FIG. 6A with the beam in a released state.
Figure 6A:
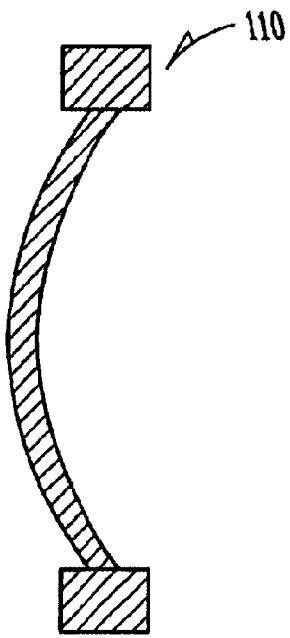
FIG. 6A illustrates another example beam that may be used in the MEMS switch of FIGS. 3A–3D with the beam in an unreleased state.

Another example beam 110 that may be used in MEMS switch 50 is shown in FIGS. 6A, 6B and 6C. Beam 110 is shown in an unreleased state in FIG. 6A and in a released state in FIG. 6B. Beam 110 has the same arc-shape before and after release such that it is not under compressive stress. During operation of a MEMS switch 50 that includes beam 110, one of the first and second electro-thermal actuators 54, 56 buckles beam 110 such that it is deflected into an opposing arc (see FIG. 6C). Beam 110 is then forced by the other of the first and second actuators 54, 56 back into its original arc-shaped, unstressed state.

Figure 7A:
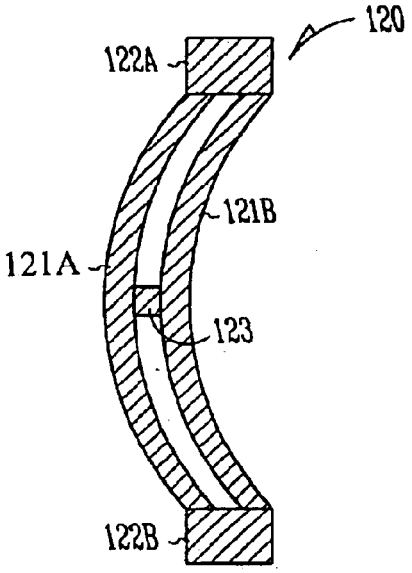
FIG. 7A illustrates another example beam that may be used the MEMS switch of FIGS. 3A–3D.
Figure 7B:
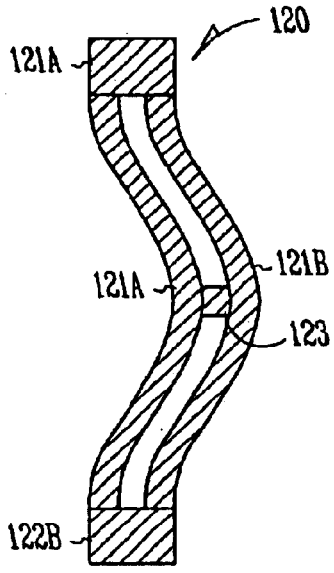
FIG. 7B illustrates the beam of FIG. 7A after the beam is buckled by an actuating force.

FIGS. 7A and 7B show a similar example beam 120. As shown in FIG. 7A, beam 120 has an arc shape similar to beam 110 when beam 120 is released. Beam 120 includes two elongated members 121A, 121B that are each secured at opposing ends to anchors 122A, 122B. A mid-portion of member 121 A is secured to a mid-portion of member 121B by a support 123.

Figure 8:
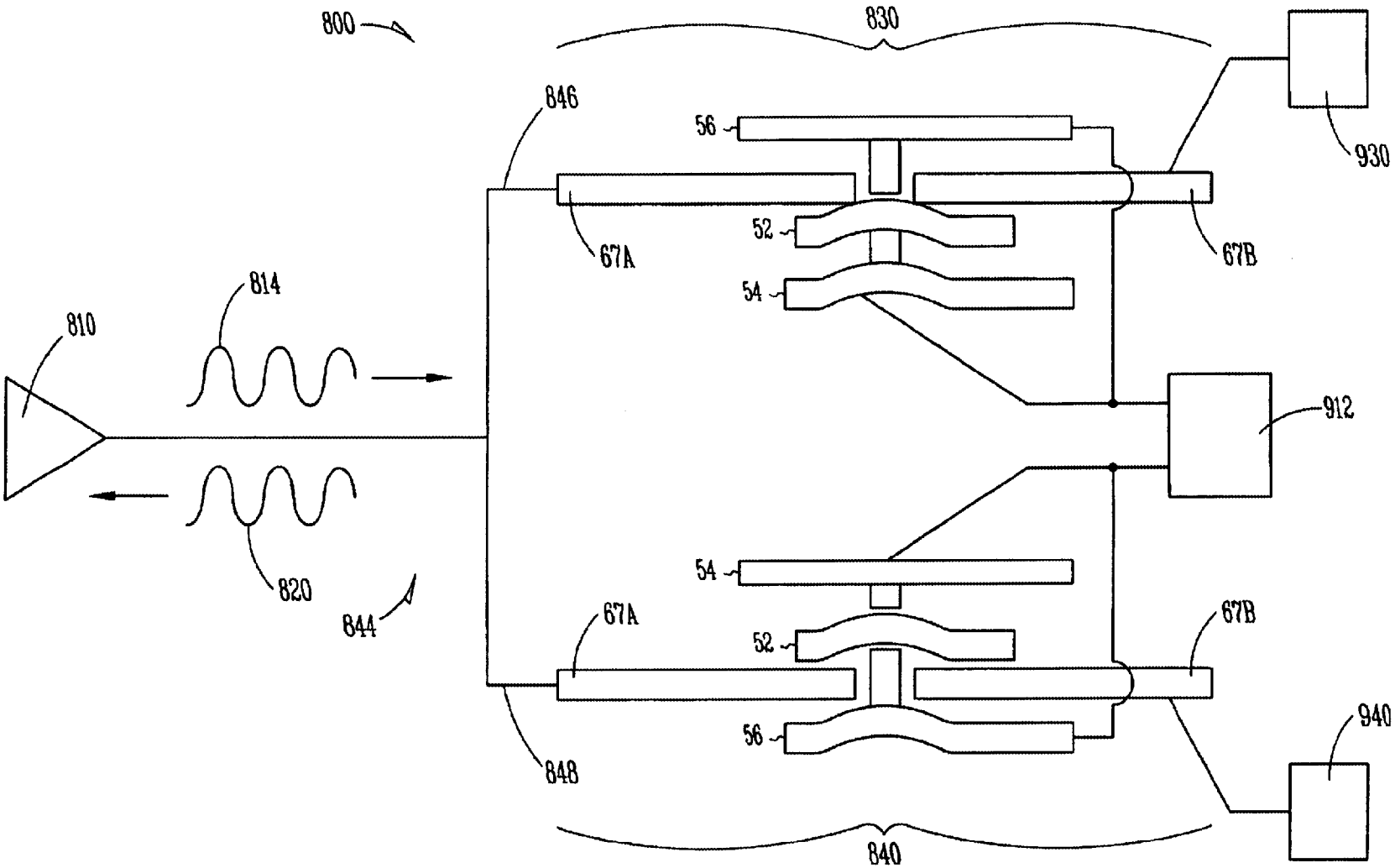
FIG. 8 is a schematic circuit diagram illustrating the MEMS switch of FIGS. 3A–3D in an example wireless communication application.

FIG. 8 shows a schematic circuit diagram of a MEMS-based wireless communication system 800 that includes MEMS switches 830, 840. In the illustrated exmple embodiment, MEMS switches 830 and 840 are the same as MEMS switch 50 described above. MEMS switches 830, 840 have intrinsic advantages over their conventional solid-state counterparts (e.g., field-effect transistor (FET) switches), including superior power efficiency, low insertion loss and excellent isolation. MEMS switches 830, 840 are suitable for switching an antenna 810 between transmit and receive in some wireless communication devices where sub-microsecond switching is not required.

System 800 includes an antenna 810 for receiving a signal 814 and transmitting a signal 820. MEMS switches 830, 840 are electrically connected to antenna 810 via a branch circuit 844 having a first branch wire 846 and a second branch wire 848. During operation a voltage source controller 912 selectively activates MEMS switches 830 and 840 so that received signal 814 can be transmitted from antenna 810 to receiver electronics 930 for processing, while transmitted signal 820 generated by transmitter electronics 940 can be passed to antenna 810 for transmission.

As described above, MEMS switches 830, 840 are off when beams 52 are disengaged from respective contacts 67A, 67B. MEMS switches 830, 840 are individually turned on by selectively applying an actuation voltage to a respective first electro-thermal actuator 54 that is in each MEMS switch 830, 840. Applying an actuation voltage to the first electro-thermal actuators 54 causes each first electro-thermal actuator 54 to buckle.

As the first electro-thermal actuator 54 in each respective MEMS switch 830, 840 buckles, it applies a force to beam 52 that is sufficient to buckle beam 52. When beam 52 buckles it electrically connects contacts 67A, 67B such that a desired one of the corresponding signals 814, 820 passes between contacts 67A, 67B along the corresponding first or second branch wire 846, 848.

MEMS switches 830, 840 are each turned off by selectively applying an actuation voltage to the respective second electro-thermal actuators 56 such that the second electro-thermal actuators 56 buckle and apply a force to respective beams 52 that is sufficient to buckle beams 52 away from contacts 67A, 67B. In one example embodiment, voltage source controller 912 includes logic for selectively supplying voltages to actuators 54, 56 in each MEMS switch 830, 840 permitting selective activation and deactivation of MEMS switches 830, 840.

Further included in system 800 are reciever electronics 930 electrically connected to MEMS switch 830, and transmitter electronics 940 electrically connected to MEMS switch 840.

MEMS switches of the example embodiments described herein may also be used in smart antenna applications where insertion loss is the most important parameter. Smart antenna applications relate to switching between a plurality of antennas within a wireless communication device. Antenna switching is often used in wireless communication applications where there are signal variations.

The MEMS switch described above provides a potential solution for applications where MEMS switches with low actuation voltage and low power consumption are desirable. The MEMS switch supplies designers with a multitude of options for developing electronic devices that include MEMS switches, such as computer systems, high speed switches, relays, shunts, surface acoustic wave switches, diaphragms and sensors. Many other embodiments will be apparent to those of skill in the art from the above description.

What is claimed is:

1. A microelectromechanical system (MEMS) switch comprising:

a beam having a first side and a second side;

a first electro-thermal actuator that applies a force to the first side of the beam as current passes through the first electro-thermal actuator; and a second electro-thermal actuator that applies a force to the second side of the beam as current passes through the second electro-thermal actuator.

2. The MEMS switch according to claim 1, wherein the first electro-thermal actuator includes a first stud that engages the first side of the beam and the second electro-thermal actuator includes a second stud that engages the second side of the beam.

3. The MEMS switch according to claim 1, further comprising a transmission line that includes at least a pair of electrically isolated contacts, the beam electrically connecting the contacts as current passes through the first electro-thermal actuator.

4. The MEMS switch according to claim 3, wherein the second electro-thermal actuator disengages the beam from the contacts as current passes through the second electro-thermal actuator.

5. The MEMS switch of claim 3, wherein the first electro-thermal actuator does not engage the beam when the beam electrically connects the contacts in the transmission line.

6. The MEMS switch of claim 5, wherein the second electro-thermal actuator does not engage the beam when the beam electrically connects the contacts in the transmission line unless current passes through the second electro-thermal actuator.

7. The MEMS switch of claim 1, wherein the beam is fixed at opposing ends to anchors.

8. The MEMS switch of claim 7, wherein the beam is buckled under a compressive stress.

9. The MEMS switch of claim 7, wherein the beam is arc-shaped.

10. The MEMS switch of claim 9, wherein the beam buckles as the first elector-thermal actuator applies a force to the beam.

11. The MEMS switch according to claim 1, wherein the first and second electro-thermal actuators each comprise a high thermal expansion conductor and a low thermal expansion dielectric.

12. The MEMS switch of claim 11, wherein the first electro-thermal actuator and the second electro-thermal actuator are each fixed at opposing ends to anchors.

13. The MEMS switch of claim 12, wherein the first electro-thermal actuator buckles as current passes through the first electro-thermal actuator and the second electro-thermal actuator buckles as current passes through the second electro-thermal actuator.

14. The MEMS switch according to claim 1, wherein the beam includes dielectric body covered with an electrical conductor.

15. A microelectromechanical (MEMS) switch comprising:

a beam having a first side and a second side;

a first electro-thermal actuator that is fixed at each end to anchors and including a high thermal expansion conductor and a low thermal expansion dielectric, the first electro-thermal actuator buckling as current passes through the first electro-thermal actuator to apply a force to the first side of the beam;

a second electro-thermal actuator that is fixed at each end to anchors and including a high thermal expansion conductor and a low thermal expansion dielectric, the second electro-thermal actuator buckling as current passes through the second electro-thermal actuator to apply a force to the second side of the beam; and a transmission line that includes at least a pair of electrically isolated contacts, the first electro-thermal actuator electrically connecting the beam to the contacts as current passes through the first electro-thermal actuator and the second electro-thermal actuator disengaging the beam from the contacts as current passes through the second electro-thermal actuator.

16. The MEMS switch of claim 15, wherein the beam is fixed at opposing ends to anchors.

17. The MEMS switch according to claim 16, wherein the beam is buckled under a compressive stress.

18. A communication system comprising:

a first MEMS switch including a beam having a first side and a second side, a first electro-thermal actuator that applies a force to the first side of the beam as current passes through the first electro-thermal actuator, and a second electro-thermal actuator that applies a force to the second side of the beam as current passes through the second electro-thermal actuator, a second MEMS switch including a beam having a first side and a second side, a first electro-thermal actuator that applies a force to the first side of the beam as current passes through the first electro-thermal actuator, and a second electro-thermal actuator that applies a force to the second side of the beam as current passes through the second electro-thermal actuator; and a voltage source controller electrically coupled to the first and second actuators to selectively activate the first and second MEMS switches.

19. The communication system of claim 18, wherein the first and second MEMS switches are electrically connected to an antenna, and wherein the first MEMS switch is electrically connected to receiver electronics that receive and process a first signal received by the antenna and the second MEMS switch is electrically connected to transmitter electronics that generate a second signal to be transmitted by the antenna.

20. The communication system of claim 18, wherein each of the beams in the first and second MEMS switches are buckled under a compressive stress.

* * * * *

UNITED STATES PATENT AND TRADEMARK OFFICE

CERTIFICATE OF CORRECTION

PATENT NO. : 6,753,582 B2
DATED : June 22, 2004
INVENTOR(S) : Ma

It is certified that error appears in the above-identified patent and that said Letters Patent is hereby corrected as shown below:

Title page,
Item [56], References Cited, OTHER PUBLICATIONS,
"Qiu, Jin., et al." reference, after "2001," insert -- (2001) --.

Column 6,
Line 51, delete "elector-thermal" and insert -- electro-thermal --.

Column 8,
Line 5, delete "actuator," and insert -- actuator; --.

Signed and Sealed this

Tenth Day of January, 2006

JON W. DUDAS
*Director of the United States Patent and Trademark Office*